US011047349B2

(12) United States Patent
Morimoto et al.

(10) Patent No.: US 11,047,349 B2
(45) Date of Patent: Jun. 29, 2021

(54) INTAKE STRUCTURE OF ENGINE

(71) Applicant: HONDA MOTOR CO., LTD., Tokyo (JP)

(72) Inventors: Tatsuya Morimoto, Wako (JP); Miyuki Ozono, Wako (JP)

(73) Assignee: HONDA MOTOR CO., LTD., Tokyo (JP)

( * ) Notice: Subject to any disclaimer, the term of this patent is extended or adjusted under 35 U.S.C. 154(b) by 0 days.

(21) Appl. No.: 16/636,720

(22) PCT Filed: Aug. 9, 2017

(86) PCT No.: PCT/JP2017/029016
§ 371 (c)(1),
(2) Date: Feb. 5, 2020

(87) PCT Pub. No.: WO2019/030878
PCT Pub. Date: Feb. 14, 2019

(65) Prior Publication Data

US 2020/0240373 A1 Jul. 30, 2020

(51) Int. Cl.
*F02M 35/10* (2006.01)
*F02D 9/10* (2006.01)

(52) U.S. Cl.
CPC ..... *F02M 35/10078* (2013.01); *F02D 9/1065* (2013.01); *F02M 35/10144* (2013.01); *F02M 35/10242* (2013.01); *F02M 35/10327* (2013.01)

(58) Field of Classification Search
CPC ..... F02M 35/10078; F02M 35/10085; F02M 35/10091; F02M 35/10144;
(Continued)

(56) References Cited

U.S. PATENT DOCUMENTS 5,575,247 A * 11/1996 Nakayama ..... F02M 35/04 123/184.21
6,026,775 A * 2/2000 Yamane ..... F02F 7/006 123/184.53

(Continued)

FOREIGN PATENT DOCUMENTS

EP 1 701 020 A1 9/2006
JP H09-217661 A 8/1997

(Continued)

OTHER PUBLICATIONS

International Search Report, dated Oct. 31, 2017, on PCT/JP2017/029016, 2 pages.

(Continued)

*Primary Examiner* — Hung Q Nguyen
(74) *Attorney, Agent, or Firm* — Rankin, Hill & Clark LLP

(57) ABSTRACT

An intake structure of an engine includes an intake manifold as an engine side-part intake member that is provided on an intake side-surface of a cylinder head and connected to an intake system, which includes a first air cleaner as an engine upper-part intake member on an upper-part of the engine body; an intake opening member including an air inlet, an intake air passage guiding air sucked by the member through the first air cleaner to the intake manifold; a resonator as one of an engine upper-surface intake members provided on an upper surface of the engine body and nearer an exhaust system than and adjacent to the first air cleaner; and an intake manifold connected to the side-surface as an engine side-part intake member.

10 Claims, 6 Drawing Sheets

(58) Field of Classification Search
CPC ..... F02M 35/10242; F02M 35/10327; F02M 35/10; F02M 35/12; F02M 35/1255; F02M 35/1261; F02M 35/14; F02D 9/1065; F02D 9/10
See application file for complete search history.

(56) References Cited

U.S. PATENT DOCUMENTS

| | | | | |
|---|---|---|---|---|
| 6,089,202 | A * | 7/2000 | Nomura | F02M 35/02 123/184.42 |
| 6,189,521 | B1 * | 2/2001 | Hancock | F02M 35/10222 123/184.47 |
| 6,192,849 | B1 * | 2/2001 | Powell | F02B 75/22 123/184.34 |
| 6,267,092 | B1 * | 7/2001 | Matsumoto | F02M 35/10052 123/184.57 |
| 6,666,182 | B2 * | 12/2003 | Schermuly | F02M 35/10045 123/184.55 |
| 7,246,593 | B2 * | 7/2007 | Murphy | F02D 9/08 123/184.57 |
| 2004/0040527 | A1 * | 3/2004 | Murphy | F02M 35/10295 123/184.21 |
| 2005/0000488 | A1 * | 1/2005 | Shibata | F02D 9/1005 123/337 |
| 2006/0060163 | A1 | 3/2006 | Vanderveen et al. | |
| 2007/0012276 | A1 * | 1/2007 | Ohara | F02M 35/04 123/184.57 |
| 2007/0069170 | A1 | 3/2007 | Aoki | |
| 2007/0245561 | A1 * | 10/2007 | Miyauchi | F02D 9/106 29/890.122 |
| 2013/0104831 | A1 * | 5/2013 | Cuniberti | F02M 35/10072 123/184.21 |

FOREIGN PATENT DOCUMENTS

| | | | | |
|---|---|---|---|---|
| JP | 11050923 | A * | 2/1999 | F02M 35/10111 |
| JP | 2000-110677 | A | 4/2000 | |
| JP | 2001-099026 | A | 4/2001 | |
| JP | 2002070672 | A * | 3/2002 | F02M 35/10144 |
| JP | 2005344555 | A * | 12/2005 | F02M 35/10137 |
| JP | 2008-223497 | A | 9/2008 | |
| JP | 2009-221869 | A | 10/2009 | |
| JP | 2011-163160 | A | 8/2011 | |

OTHER PUBLICATIONS

Witten Opinion by ISA/JP dated Oct. 31, 2017, on PCT/JP2017/029016, 5 pages.

* cited by examiner

INTAKE STRUCTURE OF ENGINE

TECHNICAL FIELD

The present invention relates to an intake structure of an engine.

BACKGROUND ART

An intake structure of a conventional engine has an intake system member such as an air cleaner connected to an intake manifold of an engine body.

The intake system member includes a resonator, a throttle body, and the like in addition to the air cleaner.

For example, one of well-known structures has the intake system members such as an air cleaner or a resonator arranged on a side-surface of the engine body nearer the vehicle compartment (see Patent Literature 1).

These intake system components can block radiated sound from the side-surface of the engine body near the vehicle compartment, and improve quietness in the vehicle compartment.

CITATION LIST

Patent Literature

Patent Literature 1: JP2011-163160 A

SUMMARY OF INVENTION

Technical Problem

In an arrangement structure of the conventional engine, if an intake system member such as an air cleaner or a resonator is arranged around the engine body, a clearance must be secured between the intake system member and an inner wall of an engine room or components surrounding the intake system members, which degrades a space efficiency.

Accordingly, it is an object of the present invention to provide an intake structure of an engine that can be assembled keeping good space efficiency.

Solution to Problem

The present invention provides an intake structure of an engine provided with a plurality of intake members, wherein the plurality of intake members include an engine upper-part intake member provided above the engine body and an engine side-part intake member provided on an intake side-surface of the engine body. And at least a portion of the engine upper-part intake member is disposed outside an intake side-surface of the engine body, and the engine side-part intake member is disposed below the engine upper-part intake member.

Advantageous Effects of Invention

The present invention provides an intake structure of an engine that can be assembled space-efficiently.

DESCRIPTION OF EMBODIMENTS

Figure 1:
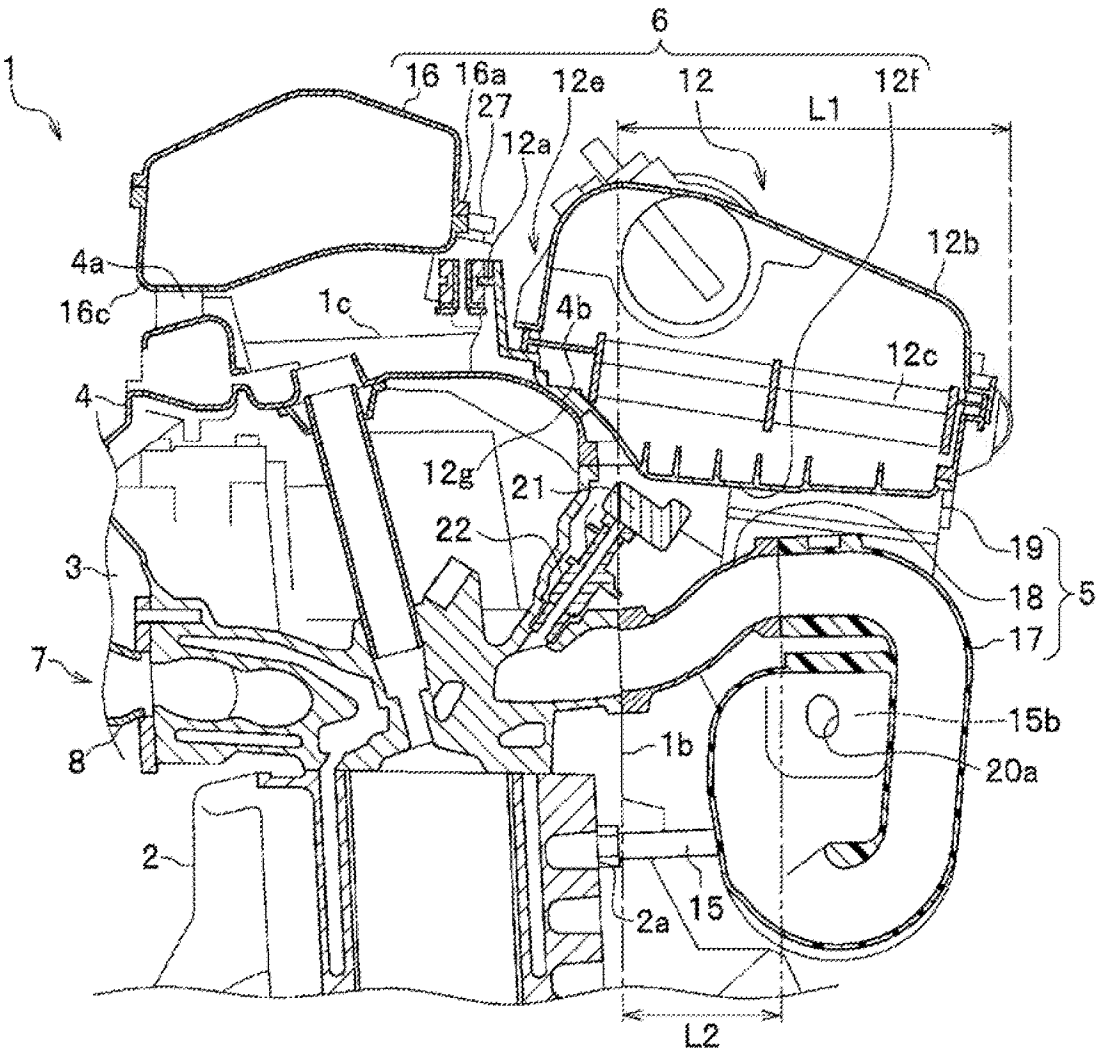
FIG. 1 is a cross-sectional view taken along a line I-I in FIG. 2, showing an intake structure of an engine and an upper structure of an engine body according to a first embodiment of the present invention.

Hereinbelow, a first embodiment of the present invention is described with reference to the drawings as appropriately as necessary. The same components are denoted by the same reference numerals, and doubled description is omitted. When describing directions, unless otherwise indicated, expressions: "front", "rear", "right", "left", "top/up", and "bottom/down" basically indicate directions based on a view from a driver. Further, "vehicle width direction" is synonymous with "left-right direction". In an engine body 1 of this first embodiment, a cylinder arrangement direction A is the same as an axial direction of an output shaft 1*a,* and the cylinder arrangement direction A is the vehicle width direction in a state in which the engine is mounted on the vehicle. Therefore, the cylinder arrangement direction A is orthogonal to a vehicle front-rear direction.

Figure 2:
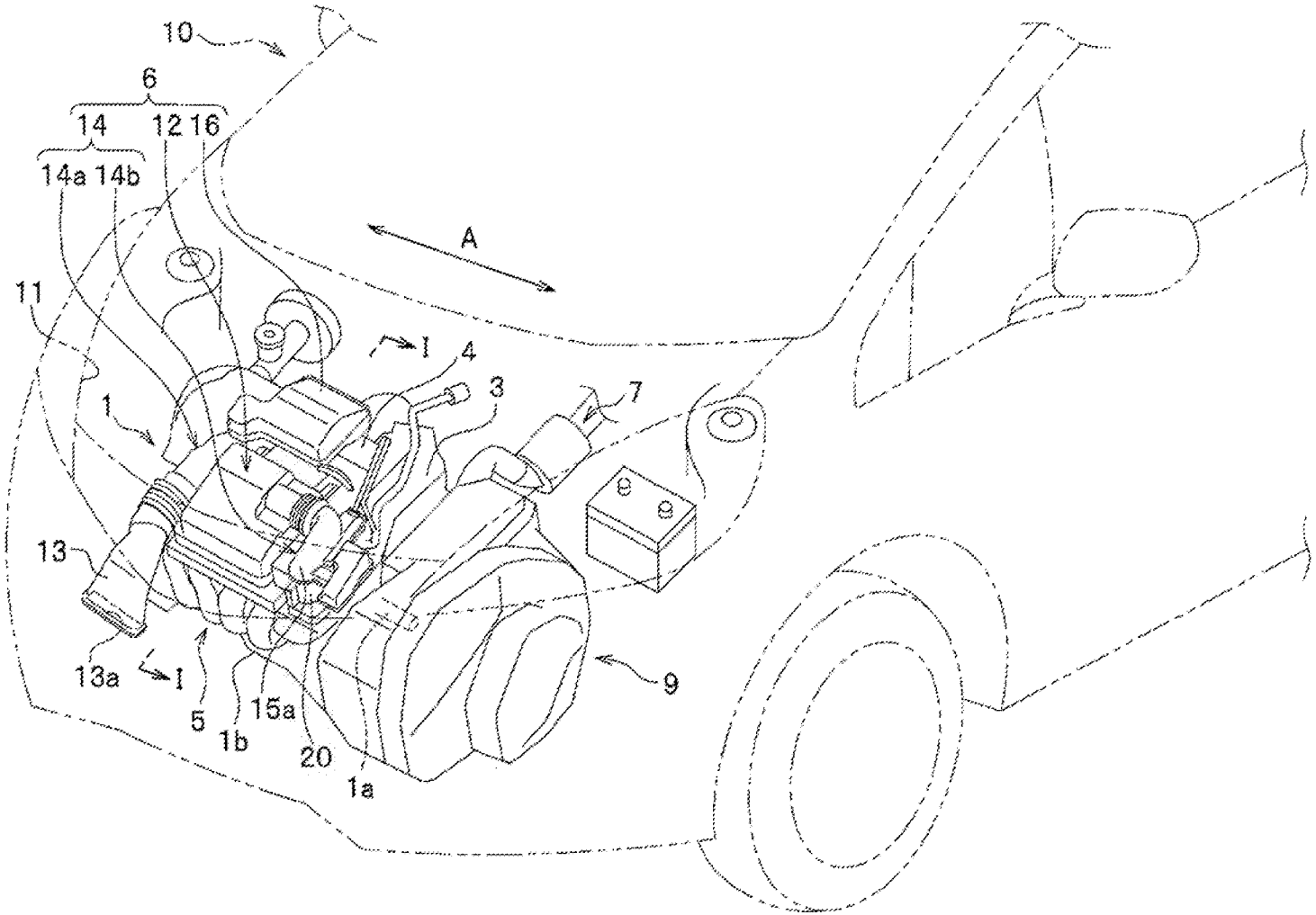
FIG. 2 is a transparent perspective view showing a state in which the engine body is mounted on a vehicle.

As shown in FIGS. 1 to 5, an engine main body 1 is mounted in an engine room 11 formed in a front portion of a vehicle 10 of this first embodiment (see FIG. 2). The engine body 1 mainly includes a cylinder block 2, a cylinder head 3, and a cylinder head cover 4 (see FIG. 3).

The cylinder block 2 of the engine body 1 is provided with a plurality of cylinders. The engine body 1 of this first embodiment is provided with four cylinders. Hereinbelow, a direction in which the plurality of cylinders of the cylinder block 2 are linearly arranged is referred to as a cylinder arrangement direction A (see FIG. 4), for the sake of description.

An output shaft 1*a* is projected from the cylinder block 2. Here, an axial direction of the output shaft 1*a* coincides with the cylinder arrangement direction A. The output shaft 1*a* is connected to a transmission unit or a hybrid unit 9 that is disposed adjacent to the engine body 1. The transmission unit or hybrid unit 9 transmits a rotational driving force to traveling wheels via a drive shaft (not shown).

An intake manifold 5 is provided as an engine side-part intake member on an intake side-surface 1*b* of the cylinder head 3, and connected to an intake system 6.

Figure 3:
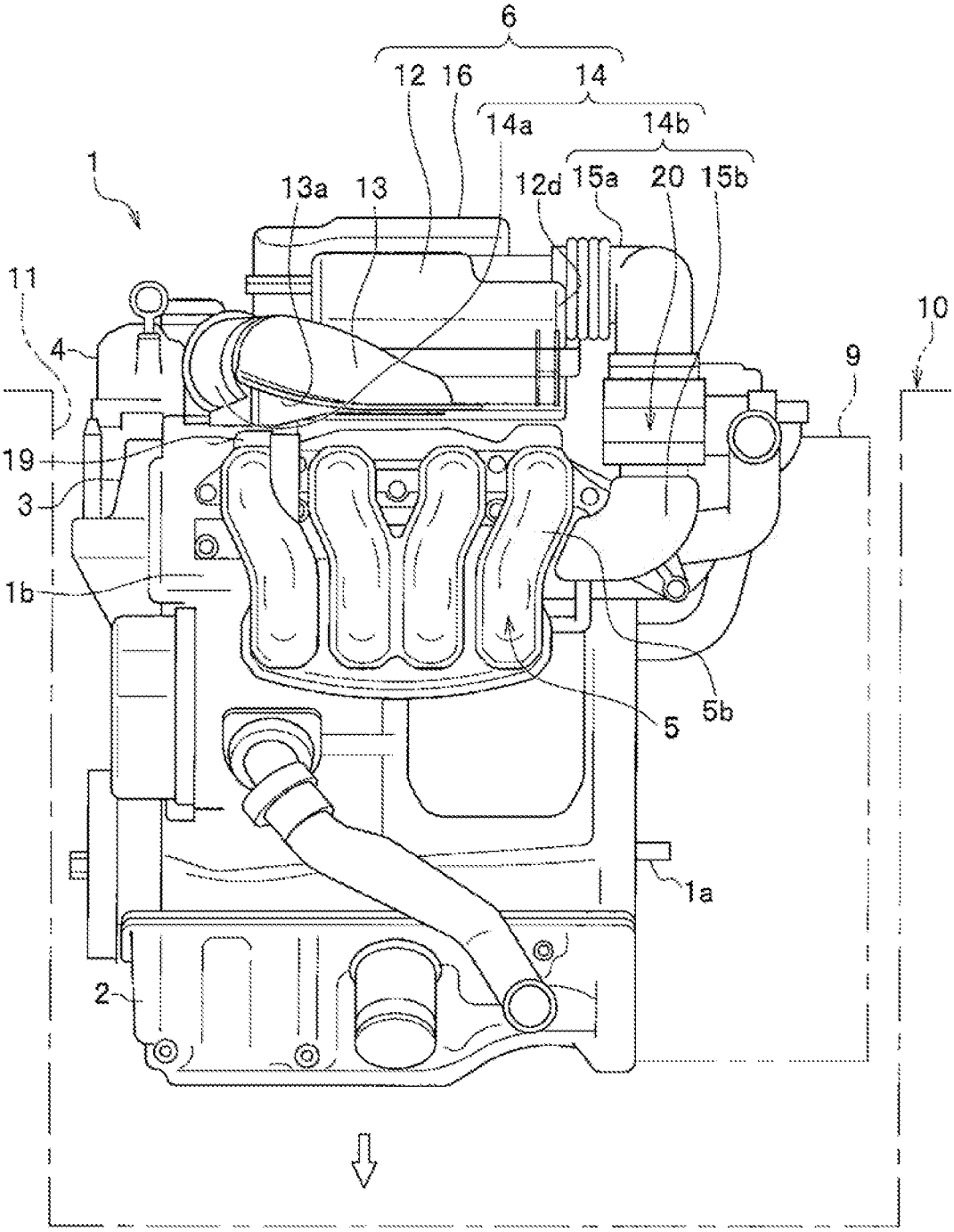
FIG. 3 is a front view of the engine body as viewed from a front of the vehicle showing the intake structure of the engine according to the first embodiment of the present invention.
Figure 4:
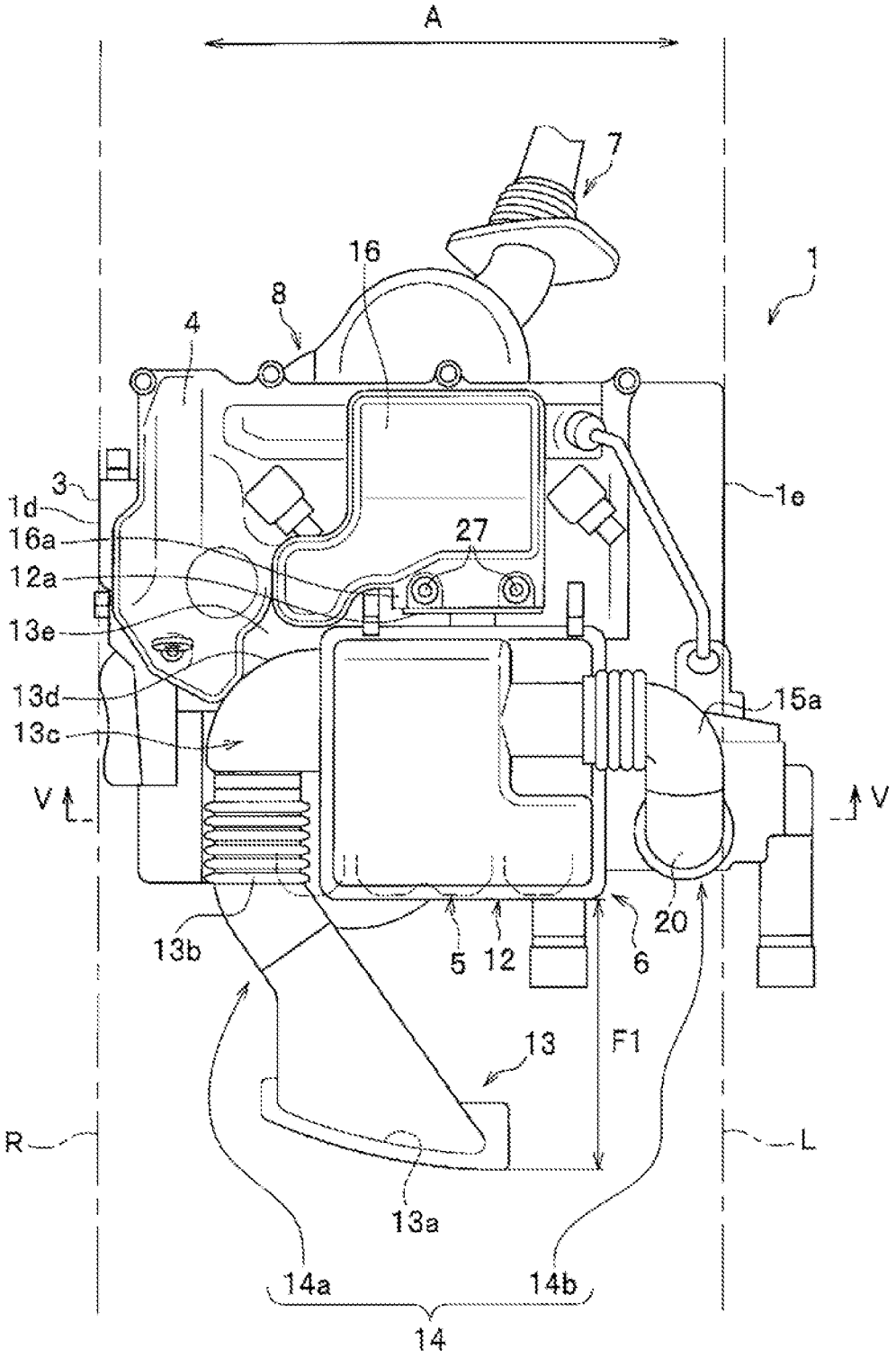
FIG. 4 is a plan view of the engine body as viewed from above showing the intake structure of the engine according to the first embodiment of the present invention.

Referring to FIGS. 3 and 4, the intake system 6 of this first embodiment includes mainly a first air cleaner 12 as an engine upper-part intake member provided on an upper-part of the engine body 1; an intake opening member 13 having an air inlet 13*a,* an intake air passage 14 that guides air sucked in by the intake opening member 13 to the intake manifold 5 through the first air cleaner 12; a resonator 16 as one of engine upper-surface intake members that are provided on an upper surface 1*c* of the engine body 1 and is placed nearer an exhaust system than and adjacent to the first air cleaner 12; and an intake manifold 5 that is connected to the intake side-surface 1*b* of the cylinder head 3 to form an engine side-part intake member.

Here, the expression "provided above the engine body 1" means a state in which at least some parts, more preferably, more than half of the engine upper-part intake member is disposed above the upper surface of the engine body 1 regardless of whether the engine upper-part intake member is mounted on the upper surface 1*c* or the intake side-surface 1*b* side of the engine body 1.

In this first embodiment, as shown in FIG. 1, the upper surface 1*c* of the engine body 1 is provided thereon with a cylinder head cover 4 that covers an upper part of the cylinder head 3. As in this first embodiment, it is enough only that more than half of the first air cleaner 12 is provided above the cylinder head cover 4 or that some or most portion of the first air cleaner 12 is provided outer than the intake side-surface 1*b*.

The cylinder head cover 4 is provided with a first air cleaner 12 and a resonator 16 connected to a top surface thereof, which means, as shown in FIG. 4, the first air cleaner 12 and the resonator 16 is provided on the upper surface of the engine body 1 to overlap the engine body 1 in a top view. Therefore, the intake system 6 can be arranged to be assembled space-efficiently by reducing an amount of protrusion outward from the side-surface of the engine body 1.

The resonator 16, the air cleaner 12 and the intake manifold 5 mainly constituting the intake system 6 are disposed to form an L-shape (or an inverted L-shape that is an upside-down shape of the character "L" when seen in the cylinder arrangement direction A of the engine body 1 shown in FIG. The shape in the cylinder arrangement direction A also includes a shape in which the first air cleaner 12 projects outward from an outer edge of the intake manifold 5 to form a nearly T-shape.

Further, the resonator 16 may be omitted, which may arrange the first air cleaner 12 and the intake manifold 5 to form a L-shape seen in the cylinder arrangement direction A.

The first air cleaner 12 of this first embodiment is formed in a shape of a hollow box, and mainly includes a projecting portion 12*b* protruding from the intake side-surface 1*b* of the engine body 1 and a remaining portion 12*e* near an exhaust system of the engine body 1 left without protruding from the intake side-surface 1*b* are provided respectively at sides near the front-rear of the vehicle.

And the first air cleaner 12 has a circular-arc-shaped recessed portion 12*g* formed in a bottom surface of the remaining part 12*e* abutting from slantingly upward against a corner portion 4*b* of the cylinder head cover 4.

Further, the intake opening member 13 is connected to communicate with the intake manifold 5 provided in the engine body 1 through the intake air passage 14 and the first air cleaner 12. The intake opening member 13 has an air inlet 13*a* formed in front of the vehicle to suck in air through the air inlet 13*a* and introduce it into the intake air passage 14.

The intake air passage 14 of this first embodiment includes a first intake air passage 14*b* and a second intake air passage 14*a*.

The second intake air passage 14*a* is provided with an intake opening member 13. The intake opening member 13 includes an air inlet 13*a* for sacking in outside air to guide the outside air into the first air cleaner 12.

The first intake air passage 14*b* guides the air from the first air cleaner 12 to the intake manifold 5 of the engine body 1.

And, the outside air guided by the first intake air passage 14*b* is introduced into the engine body 1 through the second intake air passage 14*a*, the first air cleaner 12, the first intake air passage 14*b*, and the intake manifold 5.

As shown in FIG. 4, the resonator 16 is connected to a side-surface of a curved portion 13*d* of the introduction member 13*c* in a middle of the second intake air passage 14*a*. The resonator 16 reduces noise generated during sucking in air.

The resonator 16 of this first embodiment is arranged together with the first air cleaner 12 and the air inlet 13*a* to form a line in a direction perpendicular to the cylinder arrangement direction A (front-rear direction of a vehicle) on an upper surface 1*c* of the engine body 1.

At one of the other sides, a side-surface nearer an exhaust system of the cylinder head 3 of the engine body 1 is provided an exhaust manifold 8, which is located in the exhaust system opposite to the intake manifold 5 with the cylinder head 3 interposed therebetween. The exhaust manifold 8 is connected through an exhaust system 7 such as an exhaust pipe to a muffler (not shown). And such an exhaust system 7 discharges exhaust gas from the engine body 1 to the outside of the vehicle.

The first air cleaner 12 of this first embodiment is formed in a shape like a hollow box as shown in FIG. 1, and has in its inside hollow portion an air filter 12*c*. The first air cleaner 12 has portions distinguished as a projecting portion 12*b* and a remaining portion 12*e* according to their disposed positions. That is, the first air cleaner 12 is provided with the projecting portion 12*b* formed at a side near the intake manifold 5 (front edge side), and provided at a side opposite to the projecting portion 12*b* with the remaining portion 12*e* mounted on the upper surface 1*c* of the engine body 1 integrally with the projecting portion 12*b*.

The projecting portion 12*b* projects outward (toward the front of the vehicle) by a predetermined amount L1 from the intake side-surface 1*b* of the engine body 1 in a state mounted on the upper surface 1*c* of the engine body 1, and is disposed below the projecting portion 12*b* with the intake manifold 5.

The intake manifold 5 is provided on the intake side-surface 1*b* of the engine body 1 (see FIGS. 2 and 3). The intake manifold 5 includes a resin intake manifold 17 and a port portion 18 in a manner of coupling them, wherein the port portion 18 includes at least a metal portion made of aluminum near the engine body 1.

The resin intake manifold 17 is attached to an intake opening of the cylinder head 3 by the port portion 18 and is fixed to a side-surface 2*a* of the cylinder block 2 by a support member 15.

A support member 19 is provided on an upper surface of the resin intake manifold 17. The support member 19 of this first embodiment is made of resin or metal like the resin intake manifold 17. Further, the support member 19 forms a flat plate of support surface at a position one step lower than the upper surface 1*c* of the engine body 1.

And, the projecting portion 12*b* of the first air cleaner 12 has its lower surface abutting against the support surface of the support member 19. This makes the projecting portion 12*b* of the first air cleaner 12 supported from below by the intake manifold 5.

As shown in FIG. 1, the resonator 16, the first air cleaner 12 and the intake manifold 5 arranged in the L-shape are connected to each other.

In this first embodiment, the first air cleaner 12 has the remaining portion 12*e* remaining above the engine body 1 formed with a connecting seat portion 12*a* on a lower edge of the rear wall portion facing the resonator 16. And, clip-like connecting pins 27 are used to connect a front-end portion 16*a* of the resonator 16 with the connecting seat portion 12*a* so that the front-end portion 16*a* covers the connecting seat portion 12*a* from above.

The cylinder head cover 4A is provided at its rear end portion of an upper surface with a fixing seat portion 4*a*, on whose upper surface a lower surface of an end peripheral part 16*c* of the resonator 16 is placed and fixed. This makes the first air cleaner 12 connected to the resonator 16 fixed to the cylinder head cover 4.

Further, the projecting portion 12*b* of the first air cleaner 12 has a flat lower surface 12*f*, which is placed and fixed on an upper surface of the support member 19.

Accordingly, the first air cleaner 12 is connected to the resonator 16 and the intake manifold 5 to be restricted from moving in the vehicle front-rear direction and up-down direction.

Further, as shown in FIG. 1, on the intake side-surface 1*b* of the engine body 1, a delivery pipe 21 and an injector 22 as fuel system parts are disposed adjacent to the upper portion of the intake manifold 5. Particularly, the injector 22 is provided so as to correspond to each cylinder of the cylinder block 2 and is mounted with an axial direction directed obliquely upward where the lower surface 12*f* of the first air cleaner 12 is placed.

Further, the intake manifold 5 includes the port portion 18 that is made of metal material in at least a portion near the engine body 1. This first embodiment includes the port portion 18 made of aluminum alloy. However, the present invention is not limited to this material, and the port portion 18 may include a portion made of a metal material such as another metal alloy, a synthetic resin, or a composite thereof.

The port portion 18 of this first embodiment is formed in an S-shape to curve in a side view so as to approach toward the delivery pipe 21 and the injector 22 as it goes away from the engine body 1 in the horizontal direction.

Further, as shown in FIG. 4, the first air cleaner 12 is disposed on the upper surface 1*c* of the engine body 1, particularly on a position near the intake (near the intake manifold 5) located near the front of the vehicle. And, the resonator 16 is disposed on the upper surface 1*c* of the engine body 1, particularly on a position opposite to the intake manifold 5 and near the exhaust located near the rear of the vehicle (near the exhaust manifold 8).

In the intake structure of the engine of this first embodiment, as further shown in FIG. 4, internal spaces of the first intake air passage 14*b* and the second intake air passage 14*a* respectively pass through one end 1*d* and other end 1*e* positioned at outermost of the engine body 1 in the cylinder arrangement direction A in a top view, and are accommodated in a region between a pair of virtual planes L (at the one end) and R (at the other end) that are orthogonal to the cylinder arrangement direction A.

Among these intake air passages, the first intake air passage 14*b* includes an upper curved pipe member 15*a*, a lower curved pipe member 15*b*, and a throttle body 20.

Figure 5:
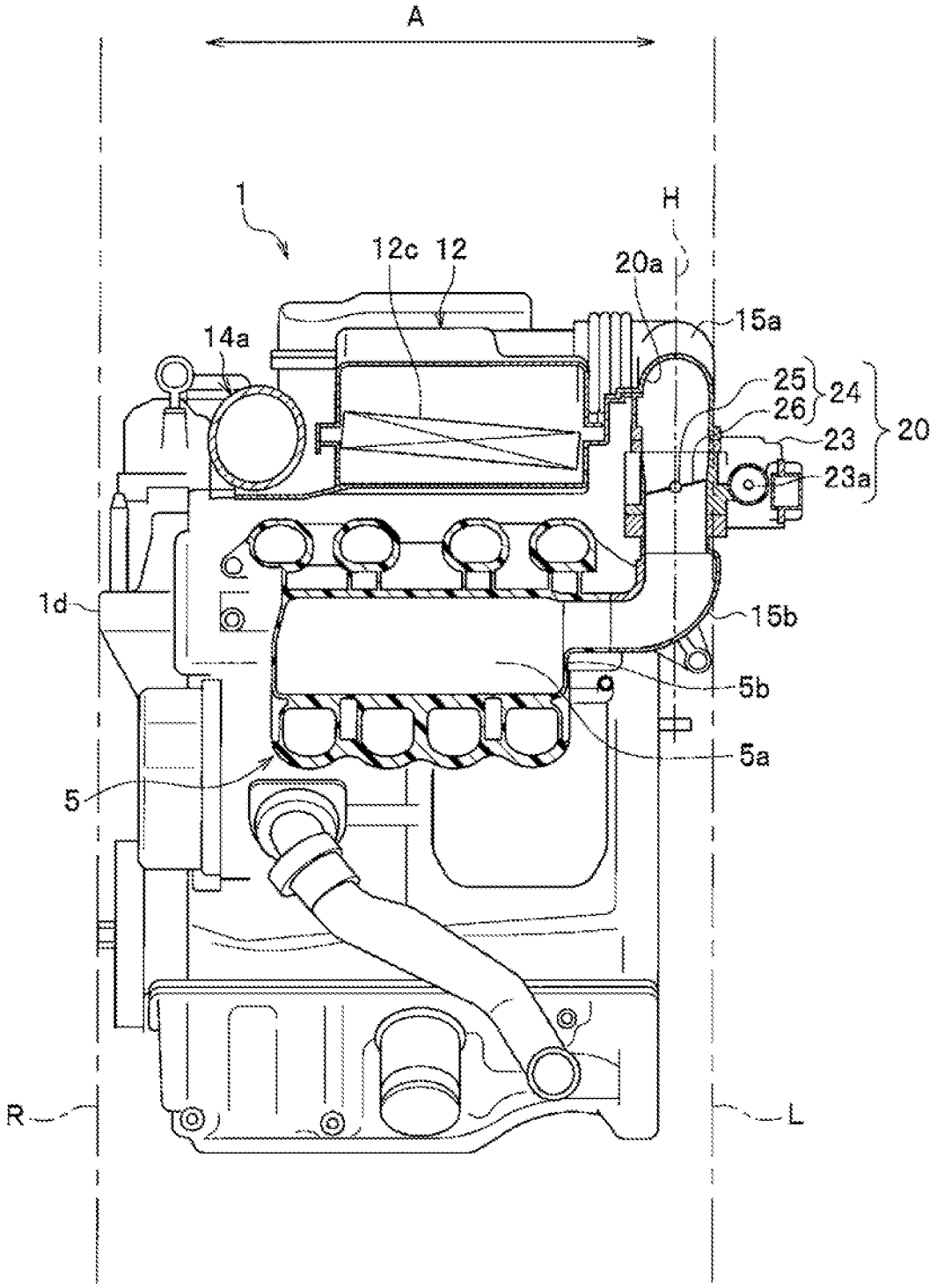
FIG. 5 is a cross-sectional view taken along a line V-V in FIG. 4, showing a configuration of a throttle body in the intake structure of the engine according to the first embodiment of the present invention.

And as shown in FIG. 5, an internal passage 20*a* of the throttle body 20 is disposed so as to be accommodated within a region between the pair of virtual planes L and R.

Further, the second intake air passage 14*a* includes an intake opening member 13, a duct member 13*b* that has an accordion-shape to be bendable, and an introduction member 13*c* that is connected to a side-surface portion of the first air cleaner 12.

Of these members, the intake opening member 13 is made of a resin material and has a funnel-shaped air inlet 13*a*. The air inlet 13*a* projects forward (downward in the drawing) more than the first air cleaner 12 on the front side of the engine body 1 and is disposed so as to be accommodated within a region between the pair of virtual planes L and R.

Furthermore, the introduction member 13*c* has a curved portion 13*d*, whose end portion is connected to the side-surface portion of the first air cleaner 12. This makes the internal space of the second intake air passage 14*a* communicate with the internal space of the first air cleaner 12.

The introducing member 13*c* has a resonator connecting portion 13*e* formed on the outer surface of the curved portion 13*d*. The resonator connecting portion 13*e* intermediates and connects between the resonator 16 and the introduction member 13*c*. This makes the internal space of the second intake air passage 14*a* communicate with an internal space of the resonator 16.

On the other hand, the intake opening member 13 is provided forward relative to the first air cleaner 12 in the vehicle front-rear direction perpendicular to the cylinder arrangement direction A, and the resonator 16 is provided rearward. Therefore, the air inlet 13*a* of the intake opening member 13, the first air cleaner 12 and the resonator 16 are arranged in a line in the vehicle front-rear direction.

As shown in FIG. 4, the second intake air passage 14*a* of this first embodiment is located closer to the engine body 1 than the virtual plane R in a top view and is accommodated in a region between the pair of virtual planes L and R.

Further, an air inlet 13*a* for sacking in outside air is formed at a front-end portion of the intake opening member 13. The air inlet 13*a* projects outward farther than the first air cleaner 12 when viewed in the cylinder arrangement direction A of the engine body 1. A protrusion length of the air inlet 13*a* is set to a desired position in a state in which the engine body 1 is mounted in the engine room 11.

Then, the engine body 1 is mounted in the engine room 11. When mounted, lowering the engine body 1 from above as shown in FIG. 3 arranges a periphery of the air inlet 13*a* at a desired portion such as a front edge portion of the engine room 11.

Further, as shown in FIGS. 3 and 4, the first intake air passage 14*b* is disposed so as to be accommodated in the region between the pair of virtual planes L and R in a top view.

Further, the first intake air passage 14*b* includes for curved pipe members an upper curved pipe member 15*a*, a throttle body 20, and a lower curved pipe member 15*b*. Among these members, the upper curved pipe member 15*a* is bent to be extended downward from a side-surface 12*d* of the first air cleaner 12. The lower curved pipe member 15*b* is connected to the side-surface 5*b* of the intake manifold 5 on the intake side-surface 1*b* of the engine body 1.

The first intake air passage 14*b* has a throttle body 20 as a connecting member connected between the upper curved pipe member 15*a* and the lower curved pipe member 15*b* at an angle in which an intake flow direction is directed in the up-down direction. The first intake air passage 14*b* guides the intake air introduced into the first air cleaner 12 from the first air cleaner 12 through the upper curved pipe member 15*a*, the throttle body 20, and the lower curved pipe member 15*b* to the intake manifold 5.

The first intake air passage 14*b* of this first embodiment is provided so as to be located closer to the engine body 1 than the virtual plane L so as to be accommodated within the region between the pair of virtual planes L and R. Therefore, the second intake air passage 14*a*, the first air cleaner 12, the resonator 16, and the first intake air passage 14*b* are all accommodated within the region between the pair of virtual planes L and R.

Further, in this first embodiment, the first intake air passage 14*b* is disposed so that the entirety of its internal passage 20*a* is accommodated within the region between the pair of virtual planes L and R.

However, the present invention is not limited to this feature, and, for example, portions such as a throttle actuator 23 that is not an internal passage may not be included in the region between the pair of virtual planes L and R, but it may be enough for this first embodiment only that the internal passage that is a main passage is included.

Here, the internal passage 20*a* that is a main passage indicates an internal space that passes a main flow that guides intake air to the engine body 1.

Accordingly, non-main stream of internal passages such as the resonator 16 may not be located between the pair of virtual planes L and R. However, it is preferable that parts such as the resonator 16 including peripheral devices surrounding the intake air passage 14 are accommodated within the region between the pair of virtual planes L and R.

Further, as shown in FIG. 1, at least a portion of the lower curved pipe member 15*b* of the first intake air passage 14*b* is disposed so as to overlap with the intake manifold 5 when viewed in the cylinder arrangement direction A. In this first embodiment, an outer side-surface of the lower curved pipe member 15*b* is provided at a position overlapping the intake manifold 5 when viewed in the cylinder arrangement direction A and accommodated more inside than an outer surface of the intake manifold 5 not to project outward.

The first intake air passage 14*b* includes the throttle body 20, which is mounted so as to have an angle in which its air flow direction H is directed in the up-down direction.

That is, as shown in FIGS. 3 and 4, the upper curved pipe member 15*a* is formed to be once bent forward at a portion connected to the side-surface of the first air cleaner 12 and curved again downward just above the throttle body 20. And then, a bottom end of the upper curved pipe member 15*a* is connected to a top end of the throttle body 20.

Further, as shown in FIG. 3, a bottom end of the throttle body 20 is connected to a vertical pipe portion of the lower curved pipe member 15*b*. The lower curved pipe member 15*b* is formed to be bent at its lower portion in the horizontal direction so as to guide the air that passes through the throttle body 20 to the intake manifold 5.

In this first embodiment, the lower curved pipe member 15*b* is bent at its bottom part at a predetermined angle (about 90 degrees) from its vertical pipe portion so as to be directed in the horizontal direction. And as shown in FIG. 5, the lower curved pipe member 15*b* has its end portion of a downstream horizontal pipe portion connected to a side-surface 5*b* of the intake manifold 5.

The throttle body 20 of this first embodiment communicates with an inside of a chamber 5*a* of the intake manifold 5 via a lower curved pipe member 15*b* having a curving shape. And, an amount of the intake air from the intake manifold 5 is regulated to vary an air-fuel mixture rate by the throttle actuator 23 when an opening degree of a butterfly valve 26 is adjusted.

Further, as shown in FIG. 5, the throttle body 20 includes a throttle actuator 23 mounted on its outer surface, a throttle valve 24 including the butterfly valve 26 disposed inside the throttle body 20, and a shaft member 25 that rotatably support the throttle valve 24.

Among these parts, the throttle actuator 23 rotates the shaft member 25 by rotating the motor shaft 23*a* according to a control command from a control unit (not shown). The rotation of the shaft member 25 allows the butterfly valve 26 of the throttle valve 24 to vary its opening degree to regulate the amount of the intake air passing therethrough.

In an example of a conventional intake structure of an engine, the throttle actuator 23 is mounted nearer the engine body 1 than the pipe of the first intake air passage 14*b*, and on an outer surface inside the throttle body 20. In this example, the pipe of the first intake air passage 14*b* is far away from the engine body 1 by a width of the throttle actuator 23.

Therefore, the intake structure of the engine of this first embodiment has the shaft member 25 arranged in parallel with the motor shaft 23*a* of the throttle actuator 23. Further, the shaft member 25 and the motor shaft 23*a* extend so as to be orthogonal to the cylinder arrangement direction A.

The motor shaft 23*a* is interlocked with the shaft member 25 via a gear mechanism as an interlocking mechanism (not shown). This allows the throttle actuator 23 to drive and rotate the motor shaft 23*a* to open and close the butterfly valve 26.

Further, the motor shaft 23*a* and the shaft member 25 align in the cylinder arrangement direction A and are interlocked by the gear mechanism. This may shorten an entire length of the motor shaft 23*a* compared with that of an intake structure forming the motor shaft 23*a* and the shaft member 25 in series with a single shaft member.

Furthermore, this first embodiment, as shown in FIG. 5, has the motor shaft 23*a* of the throttle actuator 23 arranged on a side-surface outside the pipe of the throttle body 20 so that its axial direction is perpendicular to the air flow direction H and parallel to the vehicle front-rear direction. Thereby, the motor shaft 23*a* and the shaft member 25 are arranged side by side in the cylinder arrangement direction A, to shorten a driving force transmission path from the throttle actuator 23 to the butterfly valve 26. Therefore, this may reduce an outward projection amount of the throttle actuator 23.

Next, a description is given of an effect of the intake structure of engine according to this first embodiment.

As shown in FIG. 1, in the intake structure of the engine of this first embodiment, a portion of the first air cleaner 12 provided above the engine body 1 is arranged to locate outside the intake side-surface 1*b* of the engine body 1.

And the intake manifold 5 is arranged below the projecting portion 12*b* of the first air cleaner 12. Therefore, the projecting portion 12*b* of the first air cleaner 12 is supported from below by the intake manifold 5 even when projecting toward the vehicle front more than the position of the side-surface 2*a* of the cylinder block 2. Installing the projecting portion 12*b* allows the space above the intake manifold 5 to be utilized, and further, secures a space in which the resonator 16 can be disposed on the upper surface 1*c* of the engine body 1. This allows the intake system 6 to be assembled in good space-efficiency.

The resonator 16 is provided adjacent to the first air cleaner 12 and nearer the exhaust system located opposite to the intake system than the first air cleaner 12. Then, the clip-shaped connecting pins 27 are used to connect the connecting seat portion 12*a* of the first air cleaner 12 to the front end portion 16*a* of the resonator 16.

Therefore, the first air cleaner 12 can be stably mounted even if the first air cleaner 12 projects from the upper surface 1*c* of the engine body 1 toward the vehicle front side far more than the position of the intake side-surface 1*b*. In this respect as well, the intake system 6 can be assembled space-efficiently.

As shown in FIG. 4, the resonator 16 according to this first embodiment is mounted together with the first air cleaner 12 and the air inlet 13*a* on the upper surface 1*c* of the engine body 1 to form a line in the direction orthogonal to the cylinder arrangement direction A (vehicle front-rear direction), so that the resonator 16 can be easily accommodated in the region between the pair of virtual planes L and R passing through the one end 1*d* and the other end 1*e* of the engine main body 1 to further improve the space efficiency.

Furthermore, the resonator 16, the first air cleaner 12 and the intake manifold 5 are continuously mounted in the L-shape when viewed in the cylinder arrangement direction A, so that the plurality of intake members mainly constituting the intake system 6 are disposed so as to continuously disposed from the upper surface 1*c* of the engine body 1 to the intake side-surface 1*b* thereof. Therefore, the mounting stability of the intake system 6 becomes better, and the space portion above the intake manifold 5 that has not been utilized previously can be used effectively.

Moreover, the movement of the first air cleaner 12 of this first embodiment is restricted in two directions: front-rear direction and up-down direction. Therefore, the first air cleaner 12 is further stably disposed even if it projects toward the front of the vehicle far more than the intake side-surface 1*b* of the engine body 1 by a predetermined dimension L1.

Further, the first air cleaner 12 of this first embodiment is connected to the resonator 16 and the intake manifold 5, and therefore stably attached to the upper surface 1*c* of the engine body 1.

In this first embodiment, the first air cleaner 12 has the remaining portion 12*e* existing above the engine body 1 stretched in two directions: the front-rear and up-down directions.

The first air cleaner 12 is disposed in an L-shaped corner as viewed in the cylinder arrangement direction A from above. Therefore, the circular-arc-shaped concave portion 12*g* has its concave portion engaged with a convex portion of the cylinder head cover 4 on their curved surfaces in a state of the concave portion 12*g* abutting against the corner portion 4*b* of the cover 4 from above oblique direction of the corner portion 4*b*. This results in a further stable mounting of the first air cleaner 12 even in a state thereof projecting outward (toward the front of the vehicle) by a predetermined length L1 far from the intake side-surface 1*b* of the engine body 1.

Further, the intake structure of the engine of this first embodiment, as shown in FIG. 4, mounts the first air cleaner 12 on the upper surface 1*c* of the engine body 1. This allows the internal passage 20*a* of components of the intake system 6 connecting the first air cleaner 12 and the intake manifold 5 to be accommodated in the region between the pair of virtual planes L and R respectively passing through the one end 1*d* and the other end 1*e* of the engine body 1.

Therefore, for example, as shown in FIG. 3, even if the components of the intake system 6 is in advance directly mounted on the engine body 1 and mounting the engine body 1 with the components of the intake system 6 into the engine room 11, a risk is reduced of the components of the intake system 6 interfering with an inner wall of the engine room 11 and other surrounding components. Therefore, the intake structure of the engine of this first embodiment enables efficient assembling of other components and the components of the intake system 6 while protecting both of them.

In this first embodiment, as shown in FIG. 1, the first air cleaner 12 has a projecting portion 12*b* protruding far more than the intake side-surface 1*b* of the engine body 1 by a dimension L1.

The projecting portion 12*b* has therebelow the resin intake manifold 17 of the intake manifold 5 disposed, which is formed to have a shape of winding clockwise around a chamber 5*a* as a center when viewed in FIG. 1. The intake manifold 5 is mounted on the intake side-surface 1*b* of the engine body 1 (see FIG. 2).

Therefore, the projecting portion 12*b* is stably supported from below it by the resin intake manifold 17 provided on the intake side-surface 1*b*, even if the projecting portion 12*b* of the first air cleaner 12 projects outward from the intake side-surface 1*b* of the engine body 1.

Therefore, on the upper surface 1*c* of the engine body 1, a free area adjacent to the exhaust system that is opposite to the intake manifold 5 can be enlarged. This allows the resonator 16 to be disposed in this enlarged free area to utilize a space-efficiently.

And, projecting the projecting portion 12*b* of the first air cleaner 12 by the predetermined length L1 from the intake side-surface 1*b* of the engine body 1 defines a ratio between the projecting portion 12*b* and the remaining portion 12*e*. In this first embodiment, the remaining portion 12*e* remaining on the upper surface 1*c* of the engine body 1 is configured to be shorter than the projecting portion 12*b*.

However, the ratio between the remaining portion 12*e* and the projecting portion 12*b* may not be limited to this ratio. For example, if the lower surface of the projecting portion 12*b* can be stably supported from below by the resin intake manifold 17, the ratio of the remaining portion 12*e* to the projecting portion 12*b*, for example, may be larger than the projecting portion 12*b*. The protruding length and the ratio may be configured in any way.

Additionally, this first embodiment is provided with a flat-plate like support member 19 on the upper surface 1*c* of the resin intake manifold 17.

The upper surface of the support member 19 is in contact with a lower surface of the projecting portion 12*b* and is supported by the resin intake manifold 17 on which the support member 19 is mounted.

Therefore, the projecting portion 12*b* is supported without being inclined or falling off from below by the support member 19 having a flat plate-like upper surface even if the projecting portion 12*b* is mounted in a state of projecting from the side intake side-surface 1*b* of the engine body 1 by a predetermined length L1.

Further, the shape of the resin intake manifold 17 is not decreased in its degree of freedom of shaping by the support member 19. This allows the shape of the intake air passage 14 to be a desired shape to maintain the intake efficiency in a good state.

As the predetermined projecting amount L1 of the first air cleaner 12 from the intake side-surface 1*b* increases, a free area opposite to the intake manifold 5 on the upper surface 1*c* of the engine body 1 can be expanded, which further expands the free area for mounting members on the upper surface 1*c* of the engine body 1, which surface 1*c*, as in this first embodiment, can have thereon the first air cleaner 12 and the resonator 16 arranged side by side.

Further, the support member 19 has a planar upper surface contacted to the lower surface of the projecting portion 12*b* in a manner facing each other to support the projecting portion 12*b*. The planar upper surface and the lower surface of the projecting portion 12*b* are abutted and connected to each other in the up-down direction.

Therefore, a support area can be expanded compared with a case of a point support.

Particularly, the support member 19 provided on the upper surface of the resin intake manifold 17 may be formed of a resin member. The resin member has lower heat conductivity than metal, and therefore, the support member 19 made of a resin member can regulate to decrease an amount of heat transfer between the engine body 1 and the first air cleaner 12.

That is, at the same time of further reducing an influence of heat to the air intake, the area of the support member 19 that supports the first air cleaner 12 can be increased. As described above, the configuration freedom of the area of the support member 19 increases, and therefore, the support member 19 can further stably support the projecting portion 12*b* that projects from the side-surface 1*b* of the engine main body 1.

A delivery pipe 21 and an injector 22 as fuel system components are disposed adjacent to the intake manifold 5 on the intake side-surface 1*b* of the engine body 1. The delivery pipe 21 and the injector 22 are mounted so as to direct obliquely upward to face the lower surface of the first air cleaner 12.

Further, the intake manifold 5 includes the port portion 18 that is made of metal material in at least the portion near the engine body.

The intake manifold 5 of this first embodiment includes the resin intake manifold 17 coupled to the above-mentioned port portion 18, which allows securing a desired pipe length of the intake manifold 5 to improve the intake efficiency.

Further, the intake air passage 14 includes a second intake air passage 14*a* for guiding the intake air to the first air cleaner 12, which in this first embodiment, has each intake member compactly disposed between the pair of virtual planes L and R without projecting outward.

Therefore, as shown in FIG. 3, when the engine main body 1 is lowered from above to be mounted in the engine room 11, components of the second intake air passage 14*a* do not interfere with the inner wall of the engine room 11 in which the engine main body 1 is mounted or the surrounding components.

For example, as shown in FIG. 4, the resonator 16 is mounted together with and behind the first air cleaner 12 in a line in the vehicle front-rear direction orthogonal to the cylinder arrangement direction A. Therefore, in the cylinder arrangement direction A, a free area can be formed in the space above the engine body 1 which is not occupied by the first air cleaner 12 and the resonator 16.

Therefore, the intake opening member 13, the duct member 13*b*, and the introduction member 13*c* mainly constituting the second intake air passage 14*a* can be extended along the side of the first air cleaner 12 in the direction orthogonal to the cylinder arrangement direction A.

Therefore, as shown in FIG. 3, even if the duct member 13*b* is mounted in advance at substantially the same height as the first air cleaner 12 in the up-down direction, the duct member 13*b* does not project outward from the region between the pair of virtual planes L and R.

Therefore, the engine body 1 can be inserted into the engine room 11 from above in a state in which the components such as the air inlet 13*a* and the like constituting the second intake air passage 14*a* are mounted in advance on the upper surface 1*c* of the engine body 1 together with the first air cleaner 12 and the resonator 16.

Thus, mounting in advance the components such as the intake opening member 13 and the like constituting the second intake air passage 14*a* into the engine body 1 can improve the assembly workability.

Further, as shown in FIG. 4, the intake opening member 13 is located between the pair of virtual planes L and R not to project outward from the virtual planes L and R, but further projects outward by a predetermined dimension F1 far more than the first air cleaner 12 in view of the cylinder arrangement direction A of the engine body 1.

Therefore, assembling the intake opening member 13 to the engine main body 1 in advance enables the intake opening member 13 to be disposed at a desired position such as a front end portion of the engine room 11 when mounting the engine main body 1 into the engine room 11, which allows to further improve the assembly workability.

Further, the intake air passage 14 guides the intake through the second intake air passage 14*a* air to the first air cleaner 12, to which the first intake air passage 14*b* is connected and guides the intake air from the first air cleaner 12 through the throttle body 20 to the intake manifold 5.

The second intake air passage 14*a* includes the intake opening member 13 provided with the air inlet 13*a* that introduces the outside air, in order to guide the intake air to the first air cleaner 12.

As shown in FIG. 4, the second intake air passage 14*a* of this first embodiment is disposed such that the air inlet 13*a*, the intake opening member 13, and the introduction member 13*c* are accommodated within the region between the pair of virtual planes L and R.

Further, the first intake air passage 14*b* is arranged such that at least a part of the internal passages of the upper curved pipe member 15*a*, the lower curved pipe member 15*b*, and the throttle body 20 is accommodated within the region between the pair of virtual planes L and R. In this first embodiment, the second intake air passage 14*a* and at least the internal passage 20*a* of the first intake air passage 14*b* are disposed so as to be located within the region between the pair of virtual planes L and R on both sides of the first air cleaner 12, which reduces an amount by which each component of the intake system 6 mainly constituting the second intake air passage 14*a* and the first intake air passage 14*b* projects outward from the engine body 1 to more compactly arrange their components with a better arrangement efficiency.

Further, as shown in FIG. 1, the lower curved pipe member 15*b* is overlapped with the intake manifold 5 when viewed in the cylinder arrangement direction A. Therefore, the lower curved pipe member 15*b* does not project outward from the outer surface of the intake manifold 5.

Therefore, components arranged on the inner wall in the engine room 11 or the surrounding components are unlikely to be interfered with the components constituting the first intake air passage 14*b*. This enables the advanced mounting of the components constituting the first intake air passage 14*b* onto the engine body 1, and the improved assembly workability.

As shown in FIG. 5, the throttle body 20 with the air flow direction H directed in the up-down direction can obtain downflow of air, which further improves the intake efficiency.

Further, although the throttle body 20 is mounted at an angle in which the air flow direction H is directed in the up-down direction, the lower curved pipe member 15*b* is formed to be bent, and therefore, the lower curved pipe member 15*b* can introduce the air that is changed in its intake direction into the chamber 5*a* of the intake manifold 5 in the horizontal direction.

Therefore, the freedom degree of designing the shape and capacity of the chamber 5*a* can be enlarged.

The pipe line of the throttle body 20 can be placed at an inner position close to the engine body 1 because the throttle actuator 23 has a small outward protrusion amount, and this may allow to reduce a dimension in which the pipe line of the first intake air passage 14*b* projects outward, and further to mount the first intake air passage 14*b* and the throttle body 20 at a place in which they are not likely to interfere with other components.

In this first embodiment, as shown in FIG. 1, the port portion 18 is formed in an S-shape in a side view to curve toward the fuel system components as it goes away from the engine body 1.

Therefore, the delivery pipe 21 and the injector 22 arranged between the first air cleaner 12 and the intake manifold 5 can be protected from interference with other parts.

Particularly, the port portion 18 of this first embodiment is formed to curve in an S-shape in a side view toward and come close to the delivery pipe 21 and the injector 22 as the port portion 18 goes away from the engine body 1 in the horizontal direction.

Therefore, a metal end portion of the port portion 18 can be extended to a position closer to the delivery pipe 21 and the injector 22 than the straight tubular one, and therefore, the protection of the delivery pipe 21 and the injector 22 can be further improved.

In this first embodiment, the end portion of the port portion 18 extending in the horizontal direction from the engine body 1 reaches below the support member 19, and supports the first air cleaner 12 together with the resin intake manifold 17.

Moreover, the end portion of the port portion 18 is extended to a position below the support member 19 while being curved in an S-shape and is made of metal material, and thereby, rigidity of supporting the first air cleaner 12 can be further improved.

Additionally, the above-described S-shape of the end portion of the port portion 18 formed to be curved extending to the position below the support member 19 allows the intake opening of the cylinder head 3 side and the end portion of the port portion 18 opposed to the intake opening to come close to a vertical line of the intake side-surface 1*b* without inclining their connection angles.

Further, the end of the port portion 18 close to the resin intake manifold 17 can connect with an opening at the end of the resin intake manifold 17 with a connection angle close to a vertical line of the intake side-surface 1*b*. This results in achieving an intake system piping with good intake efficiency by reducing an intake resistance while obtaining a desired pipe length.

Furthermore, in this first embodiment, an area over the delivery pipe 21 and the injector 22 is covered by the first air cleaner 12, which more reliably protect the delivery pipe 21 and the injector 22 from being interfered by other components.

Further, because the port portion 18 is formed to curve in an S-shape in a side view, the vertical position of the resin intake manifold 17 can be brought upward as compared with a case in which the port portion 18 is configured by a horizontal straight pipe.

In addition, a vertical thickness of the support member 19 interposed between the upper surface of the resin intake manifold 17 and the lower surface of the first air cleaner 12 is configured so that the upper surface of the support member 19 is lower than a vertical position of the upper surface 1*c* of the cylinder head cover, which allows the position of the lower surface of the first air cleaner 12 supported by the resin intake manifold 17 can be made upward.

This enables a desired clearance to be secured between the delivery pipe 21 and the injector 22, and the lower surface of the first air cleaner 12.

As shown in FIG. 4, the first air cleaner 12 is disposed on the upper surface 1*c* of the engine body 1 and closer to the intake manifold 5 located nearer the front of the vehicle, and the resonator 16 is disposed on the upper surface 1*c* of the engine body 1 and closer to the exhaust manifold 8 located opposite to the intake manifold 5 and nearer the rear of the vehicle.

The intake air introduced into the engine body 1 flows through the first air cleaner 12 is larger in amount than that through the resonator 16. Therefore, the first air cleaner 12 needs to be hardly affected by the exhaust heat from the engine body 1, which is achieved by disposing the first air cleaner 12 distant from the exhaust manifold 8.

Figure 6:
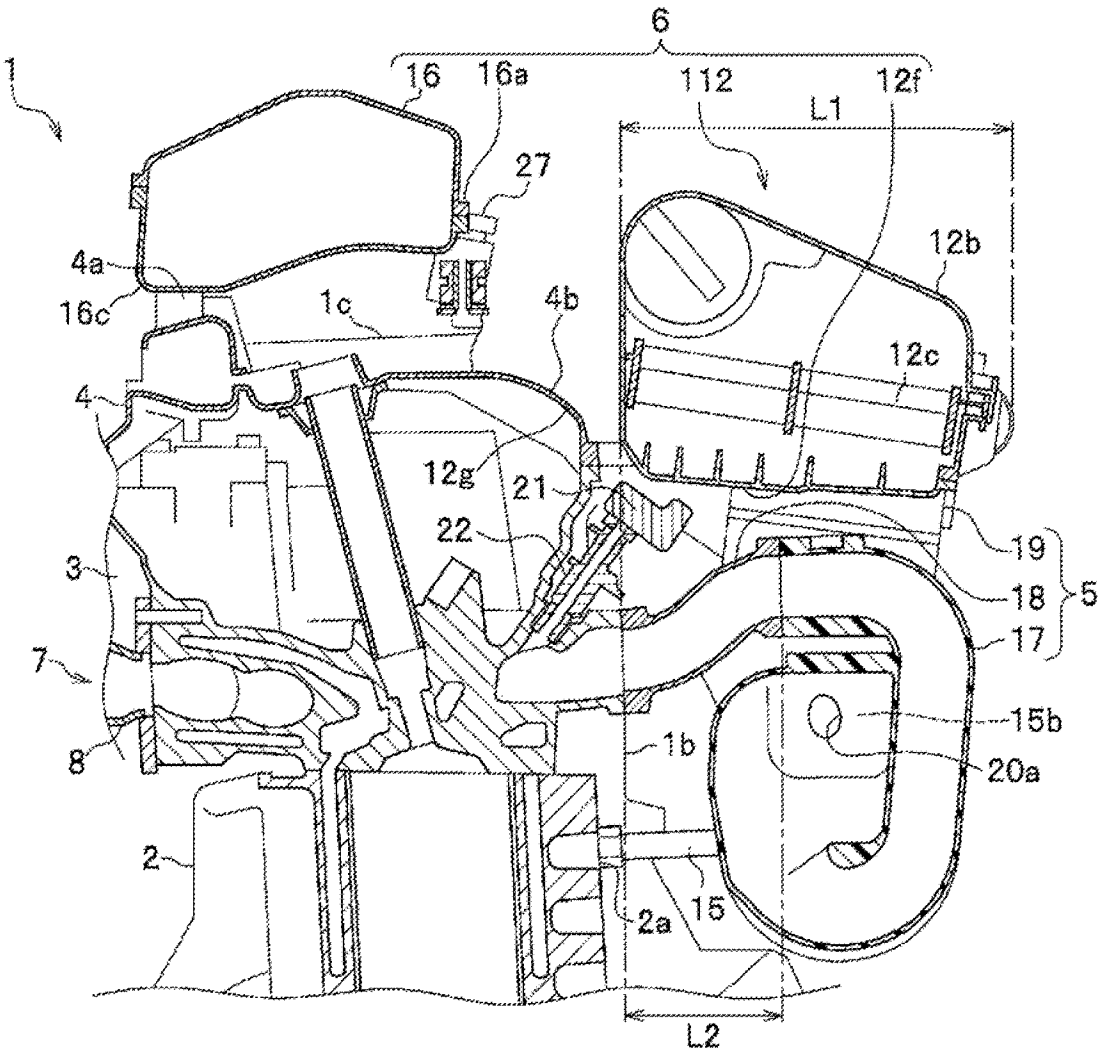
FIG. 6 is a cross-sectional view of a portion of second embodiment corresponding to that represented by FIG. 1, showing an intake structure of an engine and an upper structure of an engine body according to the second embodiment.

FIG. 6 is a cross-sectional view of a portion of another embodiment (referred to "second embodiment") corresponding to that represented by FIG. 1, showing an intake structure of an engine and an upper structure of an engine body according to the second embodiment. Please note that the parts that are the same as or equivalent to those of the first embodiment are assigned with the same reference character, and their explanations are omitted.

In this second embodiment, a second air cleaner 112 as an engine upper-part intake member is provided on an upper-part of the engine body 1. Here, more than half of the second air cleaner 112 is placed above the upper surface of the engine body 1. And, the second air cleaner 112 is arranged outward from the intake side-surface 1*b* and thereby does not overlap with the engine body 1 in a top view.

Therefore, the intake manifold 5 can be disposed below the second air cleaner 112 without positioning the engine body 1.

First, the configuration of this embodiment is described. An intake structure of the engine includes a resonator 16 as an engine upper-surface intake member placed on the upper surface 1*c* of the engine body 1.

Further, the second air cleaner 112 as the engine upper-part intake member is provided adjacent to a side nearer the intake system of the resonator 16.

Furthermore, an intake manifold 5 is provided as an engine side-part intake member below the second air cleaner 112 of this embodiment. The intake manifold 5 is placed on an intake side-surface 1*b* of the engine body 1, and is provided on the upper surface thereof with a support member 19, on whose support surface the second air cleaner 112 is placed.

In this embodiment, the entire of the second air cleaner 112 is disposed outside the intake side-surface 1*b* of the engine body 1 and supported from below by the support surface of the support member 19. Therefore, the second air cleaner 112 as the engine upper-part intake member is provided over the engine body 1, but is not present right on the upper surface of the engine body 1.

Next, effect of this embodiment is described. In the above-described configuration of the intake structure of an engine according to the second embodiment, in addition to those of the above-described first embodiment, further, the second air cleaner 112 is disposed outside the intake side-surface 1*b* of the engine body 1, and thereby almost the whole of the second air cleaner 112 is supported from below by the intake manifold 5.

This makes it easier to secure a free area for placing the resonator 16 and the like on the upper surface 1*c* of the engine body 1.

Further, this embodiment places the second air cleaner 112 on the support surface of the support member that is one-step lower than the upper surface 1*c*. Therefore, a corner portion 4*b* of the cylinder head cover 4 is made free from a portion of the second air cleaner 112, which allows securing a free area to be utilized for piping and the like above the upper surface 1*c* of the engine body 1.

Other configurations and effects are the same as or equivalent to those of the above-described first embodiment, and therefore their descriptions are omitted.

This embodiment in the above description is described such as that the intake manifold 5 is provided as an engine side-part intake member on the intake side-surface 1*b* of the engine body 1 and is disposed below the second air cleaner 112 as the engine upper-part intake member, but the present invention is not limited to this configuration.

For example, the intake manifold 5 may be provided as an engine upper-part intake member adjacent to a side nearer the intake system of the resonator 16, and the second air cleaner 112 may be provided as the engine side-part intake member on the intake side-surface 1*b* of the engine body 1. In this case, the second air cleaner 112 is disposed below the intake manifold 5. As such, the second air cleaner 112 and the resonator 16 do not need to be placed on the upper surface of the engine body 1.

The present invention is not limited to the above-described embodiments, and allows various modifications. The above-described embodiments are illustrated for easy understanding of the present invention, and are not necessarily limited to those having all the configurations described. Further, a part of a configuration of an embodiment can be replaced with a configuration of second embodiment, and a configuration of an embodiment can be added to a configuration of second embodiment. Further, a part of a configuration of each embodiment may be deleted, or to add or replace another configuration of the embodiment. Available modifications to the above embodiment are as follows, for example.

The first embodiment has the intake structure of the engine that arranges the intake manifold 5 below the first air cleaner 12 adjacent to adjacent to a side nearer the intake system of the resonator 16, and the second embodiment arranges the intake manifold 5*d* below the second air cleaner 112.

However, the present invention is not limited to those configurations, and the resonator 16, the first air cleaner 12, and the intake manifold 5 as the intake members may be assembled in any arrangement and order.

For example, even if the resonator 16 is not provided, it is sufficient if the intake manifold 5 is arranged below the first air cleaner 12.

Furthermore, although the first embodiment is demonstrated such as that the internal passage 20*a* of the first intake air passage 14*b* is accommodated in the region between the pair of virtual planes L and R, to which the present invention is not particularly limited. For example, it is only necessary that at least a portion of the internal passage 20*a* is accommodated within the region between the pair of virtual planes L and R. As described above, only if the first air cleaner 12 is provided above the engine body 1 and the first intake air passage 14*b* is a component of the intake system 6 that connects the first air cleaner 12 to the intake manifold 5 provided on the intake side-surface 1*b*, the intake members constituting the first intake air passage 14*b* are not particularly limited in their arrangements and shapes.

Further, if the intake structure has at least two or more intake members, for example, two or more resonators or two or more air cleaners may be combined, and thus the number, shape, and combination of the intake members are not particularly limited.

Further, for example, in the first embodiment, the resonator 16, the first air cleaner 12, and the intake manifold 5 are arranged in the L-shape when viewed in the cylinder arrangement direction A of the engine body 1. However, their arrangement shape viewed in the cylinder arrangement direction A may be any shape, such as a T-shape in which the first air cleaner 12 projects outward from the outer edge of the intake manifold 5 or a curved shape.

In particular, if at least a portion of the first air cleaner 12 is disposed outside the intake side-surface 1*b* of the engine body 1, for example, the projecting portion 12*b* of the first air cleaner 12 may be disposed being inclined such as that the more forward portion is more lowered.

Furthermore, for example, the whole of the first air cleaner 12 may be disposed on the upper surface 1*c* of the engine body 1 as the remaining portion 12*e* so that the first air cleaner 12 may not project outward from the intake side-surface 1*b*, which allows to make a space above the intake manifold 5 free.

Thus, the location relationship, mutual proximity degree, and a fixing method of the resonator 16, the first air cleaner 12 (or the second air cleaner 112), and the intake manifold 5 are not particularly limited.

Furthermore, a supercharger may be provided in the middle of the intake system 6. For example, some intake systems have lower pressure intake pipes located upstream of the supercharger and higher pressure intake pipes located downstream of the supercharger in the air flow direction arranged in a positional relationship in which they are stacked in the up-down direction.

In some of the above intake systems, the lower pressure intake pipes may be located above the higher pressure intake pipes and the higher pressure intake pipes below may be connected to the intake manifold 5 through the throttle valve. As in this case, the intake manifold 5 may be disposed above or at the same height as the first air cleaner 12 or the like, and the air cleaner as the engine side-part intake member may be arranged below the intake manifold 5 as the engine upper-part intake member.

The first embodiment is described above such as that the resonator 16, the first air cleaner 12, and the intake manifold 5 are all connected and mounted to the engine body 1, however, which does not limit the present invention.

It may be enough only that each component of the intake system 6 is directly or indirectly mounted on the engine body 1. For example, they may be all arranged independently and not connected to each other; only the resonator 16 and the first air cleaner 12 may be connected therebetween; or only the first air cleaner 12 and the intake manifold may be connected therebetween.

And, the first embodiment described as such that the intake manifold 5 is mounted on the intake side-surface 1*b* of the engine body 1, i.e., nearer the front of the vehicle 10, however, which does not limit the present invention . For example, the intake manifold 5 may be located on either the right or left side-surface of the engine body 1, and the shape and size of the intake manifold 5, and the position of the side-surface of the engine body 1 on which the intake manifold 5 is formed are not limited.

Furthermore, the engine body 1 of this embodiment is provided with four cylinders, and those cylinders arrangement direction A is used to define the arrangement direction of each component, to which, however, the present invention is not limited. For example, the number of cylinders may be a single cylinder or multiple cylinders such as two or more cylinders. And, for example, a rotary engine may adopt the present invention by defining its output shaft direction as the cylinder arrangement direction A. Thus, the present invention is not particularly limited in the shape, the number of cylinders, and an engine type such as diesel and gasoline of the engine body 1.

Further, in the first embodiment, the lower curved pipe member 15*b* of the first intake air passage 14*b* shown in FIG. 3 is overlapped with the intake manifold 5 when viewed in the cylinder arrangement direction A (see FIG. 1).

However, the present invention is not limited to this configuration, and it is sufficient that at least a portion of the lower curved pipe member 15*b*, the throttle body 20, or the upper curved pipe member 15*a* overlaps the intake manifold 5 when viewed in the cylinder arrangement direction A.

In this embodiment, as shown in FIG. 5, the motor shaft 23*a* of the throttle actuator 23 is provided with its axis orthogonal to the air flow direction H so as to be parallel to the side-surface outside the pipe of the throttle body 20 along the front-rear direction of the pipe body of the throttle body 20. However, the present invention is not limited to this configuration; for example, the motor shaft 23*a* and the shaft member 25 may be arranged in a direction orthogonal to the cylinder arrangement direction A. In this case as well, dimensions in the axial direction of each motor shaft 23*a* and the shaft member 25 can be made short. Accordingly, this configuration allows reducing the outward projection length of the throttle actuator 23.

Furthermore, the first embodiment has the port portion 18 formed in the S-shape so that it is curved toward and come close to the delivery pipe 21 and the injector 22 as the port portion 18 goes away from the engine body 1.

However, the present invention is not limited to this configuration, and the port portion 18 may be formed in any shape, such as a shape formed by combining a plurality of arcs having the same radius of curvatures, or arcs having different radius of curvatures; or a shape having a curved portion in a portion of a straight line, or a shape formed by combining a straight portion and a plurality of curved portions.

That is, the port portion 18 may be in any shape only if it curves toward the fuel system components such as the delivery pipe 21 or the injector 22 as the port portion 1 goes away from the engine body 1.

REFERENCE SIGNS LIST

1: engine main body
1*b*: intake side-surface
1*c*: upper surface
1*d*: one end
1*e*: other end
5: intake manifold (intake member nearer an engine)
12: first air cleaner (engine upper-part intake member)
13: intake opening member
13*a*: air inlet
14: intake air passage
14*a*: second intake air passage (one of intake air passage)
14*b*: first intake air passage (one of intake air passage)
16: resonator (one of engine upper-surface intake member)
18: port portion
20: throttle body (connecting member)
20*a*: internal passage
21: delivery pipe (one of fuel system component)
22: injector (one of fuel system component)
23: throttle actuator
23*a*: motor shaft
24: throttle valve
25: shaft member
27: connecting pin
112: second air cleaner (engine upper-part intake member)
L, R: virtual plane

What is claimed is:

1. An intake structure of an engine comprising a plurality of intake members, the plurality of intake members including:

an engine upper-part intake member provided above an engine body and an engine side-part intake member provided on an intake side-surface of the engine body, and a resonator placed on a fixing seat portion and fixed adjacent to an exhaust, the fixing seat portion being formed nearer the exhaust opposite to an intake and above an upper surface of the engine body, wherein the engine upper-part intake member includes at least an air cleaner and an intake opening member that is connected to a side surface of the air cleaner and guides sucked air to the air cleaner, the engine side-part intake member is disposed below the air cleaner and outside the intake side-surface of the engine body, the intake opening member includes an air inlet through which air is sucked in, the air inlet connects to an introduction member and projects more forward than the engine side-part intake member, the resonator is connected to an outer side-surface of a curved portion of the introduction member, the curved portion being connected to the side-surface of the air cleaner, and the air cleaner, the air inlet, and the resonator are arranged in parallel to form a line in a direction perpendicular to a cylinder arrangement direction.

2. The intake structure of the engine according to claim 1, wherein the plurality of the intake members are arranged in an L-shape when viewed in the cylinder arrangement direction of the engine body.

3. The intake structure of the engine according to claim 1, wherein a first intake air passage that is a member of an intake air passage includes the engine upper-part intake member, the engine side-part intake member, and a connecting member connecting the engine upper-part intake member with the engine side-part intake member; and an internal space of the first intake air passage is arranged so as to be accommodated in a region between a pair of virtual planes that respectively pass through one end and an other end that are positioned outermost of the engine body and that are orthogonal to the cylinder arrangement direction.

4. The intake structure of the engine according to claim 3, wherein the intake air passage includes a second intake air passage for guiding intake air to the engine upper-part intake member.

5. The intake structure of the engine according to claim 4, wherein the second intake air passage includes the air inlet for sucking in outside air.

6. The intake structure of the engine according to claim 5, wherein at least the internal space of the first intake air passage and the second intake air passage are disposed so as to be accommodated within the region between the pair of the virtual planes.

7. The intake structure of the engine according to claim 4, wherein the connecting member is a throttle body mounted at an angle in which a flow direction of the intake air is directed in an up-down direction.

8. The intake structure of the engine according to claim 7, further comprising an interlocking mechanism that interlocks a shaft member of a throttle valve with a motor shaft of a throttle actuator;

the shaft member being rotatably provided inside the throttle body;

the throttle actuator being mounted on an outer side-surface of the throttle body; and the motor shaft of the throttle actuator being disposed in parallel with the shaft member.

9. The intake structure of the engine according to claim 1, wherein the engine side-part intake member is an intake manifold.

10. The intake structure of the engine according to claim 9, further comprising a fuel system component disposed on the intake side-surface of the engine body and adjacent to the intake manifold, wherein the intake manifold includes a port portion that is made of metal material in at least a portion near the engine body; and the port portion is formed to curve toward the fuel system component as the port portion goes away from the engine body.

* * * * *